US007189950B2

(12) United States Patent
Ko

(10) Patent No.: US 7,189,950 B2
(45) Date of Patent: Mar. 13, 2007

(54) ELECTRIC OVEN

(75) Inventor: Yeong Cheol Ko, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/456,522

(22) Filed: Jun. 9, 2003

(65) Prior Publication Data

US 2004/0129698 A1 Jul. 8, 2004

(30) Foreign Application Priority Data

Jan. 6, 2003 (KR) ..... 10-2003-0000555

(51) Int. Cl.
*H05B 6/80* (2006.01)
*A21B 1/00* (2006.01)

(52) U.S. Cl. ..... 219/685; 219/756; 219/763; 219/403; 219/452.13; 99/340

(58) Field of Classification Search ..... 219/403, 219/695, 756, 762, 763, 401, 404, 739, 385, 219/521, 392, 393, 395, 396, 397, 407, 452.13, 219/453.11, 453.12, 443.1, 450.1, 451.1, 219/416, 472, 474, 418, 400, 685, 700; 126/332, 126/337 R, 339; 99/340; 392/407
See application file for complete search history.

(56) References Cited

U.S. PATENT DOCUMENTS 1,208,637 A 12/1916 Phelps
1,936,215 A * 11/1933 Speaker ..... 219/452.13
2,702,848 A * 2/1955 Scofield et al. ..... 126/4
3,169,517 A * 2/1965 Maier ..... 126/37 B
3,222,115 A * 12/1965 Urbank ..... 312/333
4,198,553 A * 4/1980 Dills ..... 219/685
4,278,877 A * 7/1981 Werych ..... 219/544
4,304,974 A * 12/1981 Ikeda et al. ..... 219/749
4,780,597 A * 10/1988 Linhart et al. ..... 219/404
5,272,317 A * 12/1993 Ryu ..... 219/403
5,345,068 A 9/1994 Hatano et al.
5,907,663 A * 5/1999 Lee ..... 392/407
5,934,180 A * 8/1999 Lin ..... 99/340
5,938,959 A * 8/1999 Wang ..... 219/401
6,114,665 A * 9/2000 Garcia et al. ..... 219/404
2004/0031791 A1* 2/2004 Han et al. ..... 219/739

FOREIGN PATENT DOCUMENTS

JP 62-84229 4/1987
JP 362084229 * 4/1987

* cited by examiner

*Primary Examiner*—Philip H. Leung
(74) *Attorney, Agent, or Firm*—Staas & Halsey LLP

(57) ABSTRACT

An electric oven capable of cooking food in a cook-top way. The electric oven according to the present invention includes a cabinet which forms an appearance of the electric oven, a cooking cavity defined inside the cabinet and having an opening front part to contain food therein, and a heater movably mounted in the cooking cavity and moves forward from the cooking cavity through the opening front part so as to cook food in cook-top way. The heater may heat the inner part of the cooking cavity also so as to cook food in a conventional oven-cooking manner.

1 Claim, 4 Drawing Sheets

ELECTRIC OVEN

CROSS-REFERENCE TO RELATED APPLICATIONS

This application claims the benefit of Korean Application No. 2003-555, filed Jan. 6, 2003, in the Korean Intellectual Property Office, the disclosure of which is incorporated herein by reference.

BACKGROUND OF THE INVENTION

1. Field of the Invention

The present invention relates to electric ovens, and more particularly, to an electric oven provided with a heater which is pulled out from a cooking cavity and enables to cook and/or heat food in a cook-top way.

2. Description of the Related Art

In general, an electric oven is an electrically operated oven which heats and/or cooks food contained in its cooking cavity through transforming electric energy to heat energy. The conventional electric oven comprises a cabinet which forms the outer appearance of the electric oven and a cooking cavity which is defined inside the cabinet with an opening at front and used for cooking food therein. A heater is defined inside the oven and generates heat when the electric power is supplied to heat the inner space of cooking cavity. In addition, users put the food they want to cook in the cooking cavity and turn on the heater to generate heat for cooking.

In such a conventional oven, as the volume of a cooking cavity is predetermined, the food or cooking container which is bigger than the opening of the cooking cavity is impossible to be heated and/or cooked. In addition, an additional cook-top way equipment which heats a food container on top of it, for example, a gas range, is needed to cook food or heat the cooking container which can not be put in the cooking cavity.

SUMMARY OF THE INVENTION

Accordingly, it is an aspect of the present invention to provide an electric oven to cook food not only in a conventional manner but also in a cook-top way.

Additional aspects and advantages of the invention will be set forth in part in the description which follows and, in part, will be obvious from the description, or maybe learned by practice of the invention.

The foregoing and/or other aspects of the present invention are achieved by providing an electric oven comprising a cabinet which forms an appearance of the electric oven, a cooking cavity defined inside the cabinet and having an opening at a front to contain food therein, and a heater which is mounted in the cooking cavity to move forward and backward, and to project from the cooking cavity to cook food in a cook-top way when it is moved forward through the opening at the front of the cooking cavity.

Accordingly, the heater is plate shaped and has an electric heating coil therein to generate heat when electric power is supplied thereto.

Accordingly, the heater is defined in the cabinet at a position at the bottom of the cooking cavity and directly heats food in contact therewith or heats food positioned on the bottom of the food container which is contained in the cooking cavity.

According to an aspect of the present invention, a magnetron is installed in the cabinet and radiates high frequency electromagnetic waves, so called "microwaves," through the cooking cavity. The microwaves penetrate food so as to repeatedly change the molecular arrangement of moisture laden in the food. That is, the moisture molecules are vibrated to generate a frictional heat within the food to cook the food.

According to another aspect of the present invention, the heater is positioned at the upper part of the cooking cavity to grill food in the cooking cavity.

In addition, a heater guiding rail is provided at both side parts of the cooking cavity to support both side ends of the heater to move forward and backward. The above heater has connecting parts at its front and rear end. A connecting terminal is provided in the cooking cavity to supply electric power to the heater by connecting with the front connecting parts when the heater is contained in the cooking cavity and by connecting with the rear connecting parts when the heater is projected through the opening of the cooking cavity.

The connecting parts are concave in the heater. The connecting terminal is made of elastic material so as to allow it to be vertically movable and provide guide protrusions so that it can be connected to the connecting parts.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
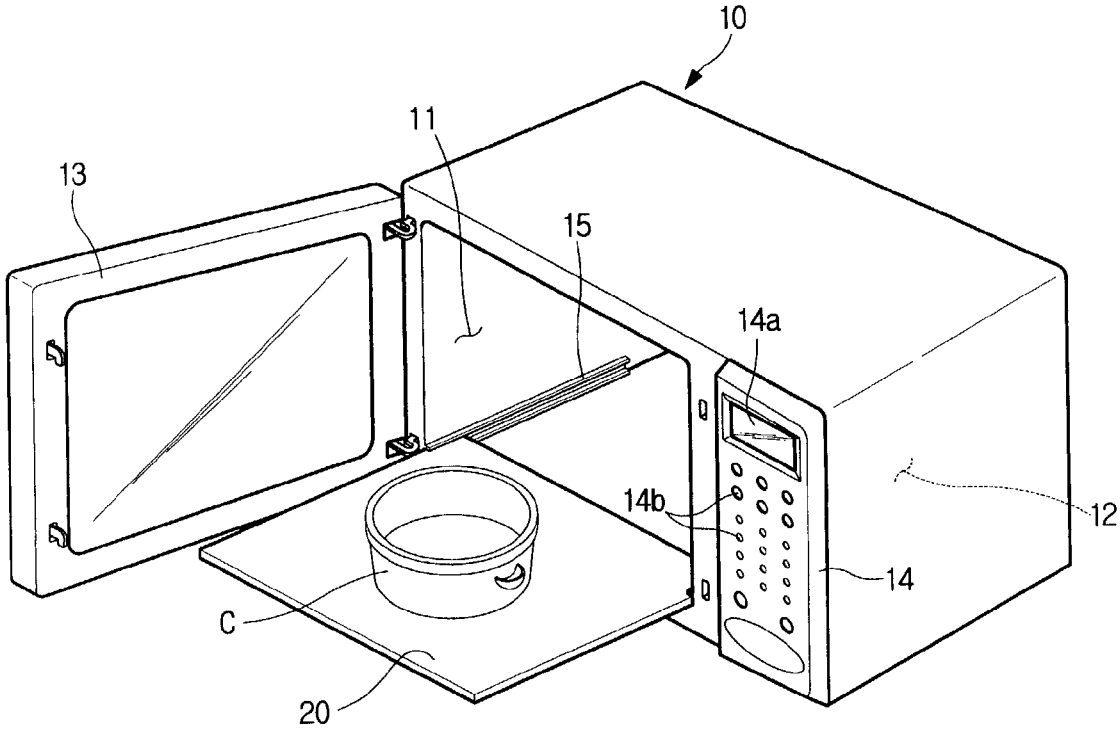
FIG. 1 is a perspective view of an electric oven according to an embodiment of the present invention.

Reference will now be made in detail to the embodiments of the present invention, examples of which are illustrated in the accompanying drawings, wherein like reference numerals to the like elements throughout. The embodiments are described below in order to explain the present invention by referring to the figures.

Figure 2:
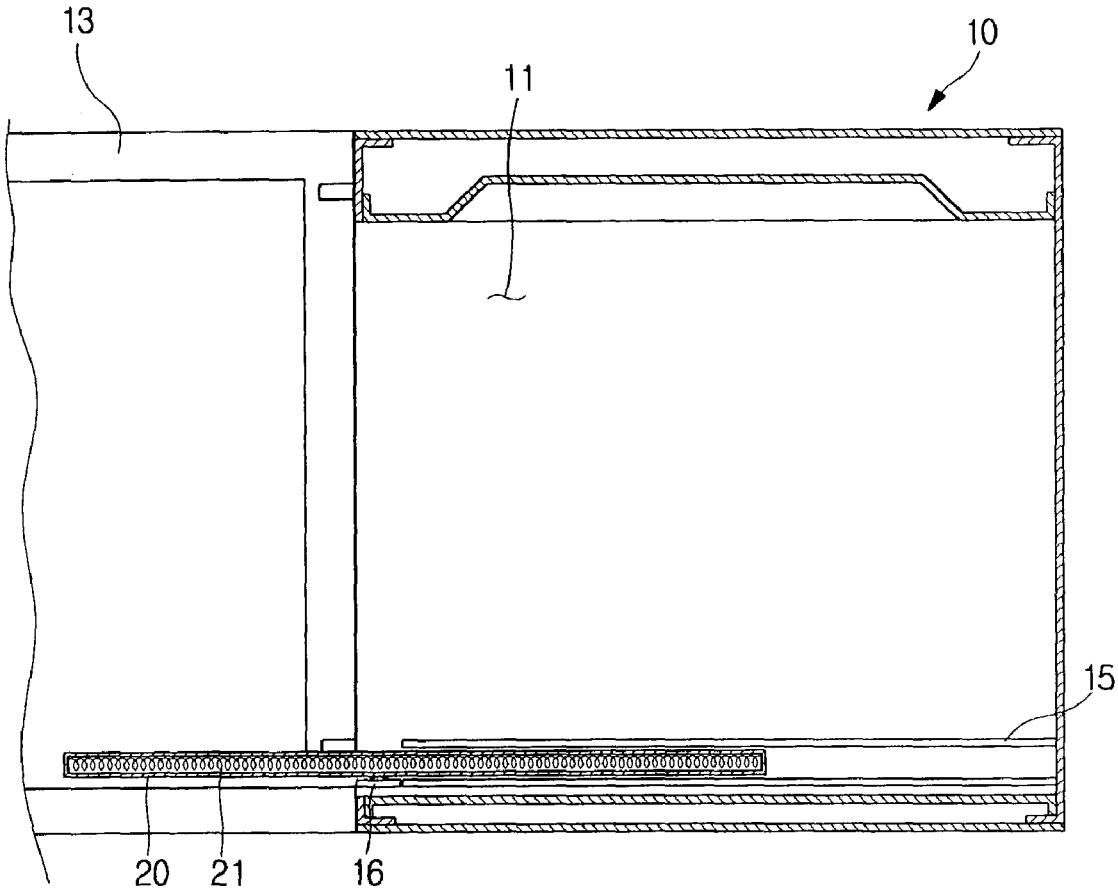
FIG. 2 is a sectional view of side parts of an electric oven according to the embodiment of FIG. 1.

FIG. 1 shows an electric oven according to an embodiment of the present invention. FIG. 2 shows side parts of an electric oven according to the embodiment of FIG. 1.

As shown in FIGS. 1 and 2, a cabinet 10, which forms an outer appearance of a microwave oven, is divided into a cooking cavity 11 which is used to cook food therein and a machine room 12 which receives a variety of devices.

The cooking cavity 11 has an opening front part so that users can put food into and take food out of the cooking cavity 11. A door 13 is mounted in the front of the cabinet 10 to selectively open and close the opening part of the cooking cavity 11.

In front of the machine room 12 there are a display part 14*a* which shows the operation status of the electric oven and a control panel which is equipped with a lot of buttons 14*b* to control the operation of the electric oven, so that users can operate the electric oven. A heater 20 is mounted in the cooking cavity 11 to heat the inner part of the cooking cavity 11.

The heater 20 may be plate shaped, has a built-in electric heat coil (not shown) and is movably mounted in the cooking cavity 11 so as to heat the cooking cavity 11 to cook food therein. Additionally, the heater 20 may be moved forward through the opening front part so that users can put food or a cooking container C containing food on top of the heater 20 to cook food in a cook-top way when it is required.

Guide rails 15, respectively, are provided on both of two inner side parts of the cooking cavity 11 to provide forward movement of the heater 20. The guide rails 15 are formed in approximately the same shape with respect to each other, and are mounted directly opposite to each other within the cooking cavity 11.

Thus, both ends of the plate shaped heater 20 may be guided by the guide rails 15 to be projected through the opening part.

Figure 3:
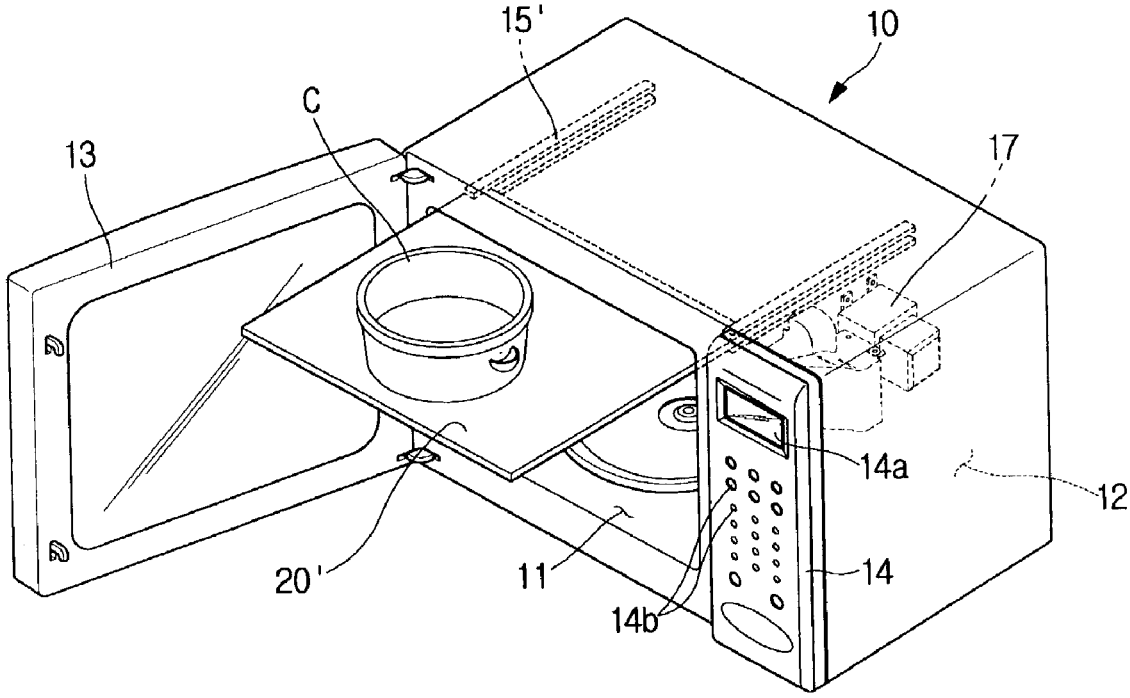
FIG. 3 is a perspective view of a heater and a power terminal which supplies electrical power to a heater according to the embodiment of FIG. 1.

FIG. 3 shows a heater 20', while FIG. 2 shows a power terminal 16 which supplies electrical power to a heater 20 or 20' according to the embodiments of the present invention.

Figure 4:
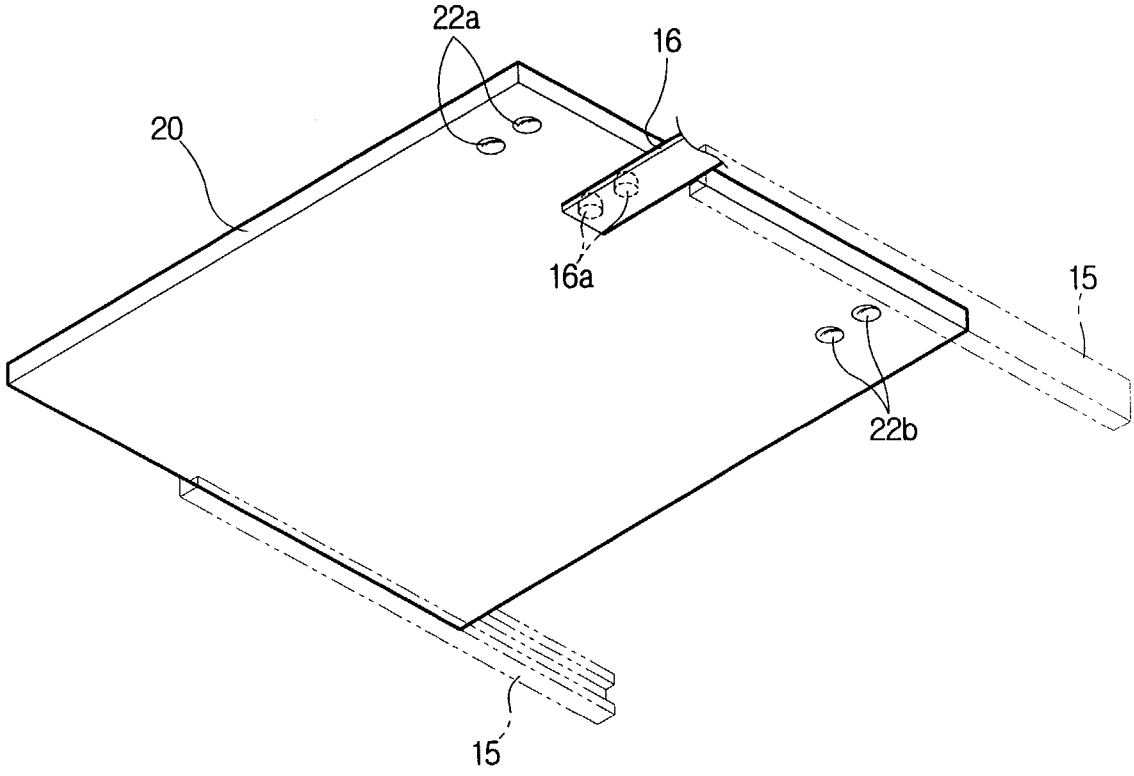
FIG. 4 is a perspective view of an electric oven according to another embodiment of the present invention.

FIG. 4 shows an electric oven according to another embodiment of the present invention.

As shown in FIG. 4, an electric terminal 16 projects near the opening part of the cooking cavity to supply electric power to the electric heat coil 21. Connecting parts 22*a* and 22*b* are separately provided at front and rear parts of the lower surface of the heater 20. The first connecting parts 22*a* are installed at the front parts of the lower surface of the heater 20 and the second connecting parts 22*b* are installed at the rear part of the lower surface of the heater 20.

The electric terminal 16 is plate shaped and may be vertically transformed by its elasticity. The upper surface of the electric terminal 16 has a pair of connecting projections 16*a*. In addition to connecting with the first connecting parts 22*a*, the connecting projections 16*a* connect with the second connecting parts 22*b* and supply electric power to the electric heat coil 21 when the heater 20 stays in the cooking cavity 11. When the heater 20 is projected forward, the connecting projections 16*a* connect with the first connection parts 22*a* and supply electric power to the heat coil 21.

Additionally, as the electric terminal 16 may be transformed vertically by its elasticity, the electric terminal 16 elastically may be transformed downward to the connecting projections 16*a* which slide along the lower surface of the heater 20 when the heater moves forward and backward.

According to the present embodiments, the heater 20 generates heat by the built-in electric heat coil 21, but various types of heaters 20 may be mounted movably in the cooking cavity according to its necessity.

As shown in FIG. 4, the electric oven according to this embodiment cooks food only by the heat generated from the electric heat coil 21, but the electric oven may be substituted with a microwave oven equipped with a magnetron, which generates high-frequency electromagnetic waves. In this embodiment of the present invention, the heater 20 is mounted at an upper part of the cooking cavity 11 to move forward and backward by the guiding rail 15, thus providing a grilling effect. The heater 20 usually stays in the cooking cavity 11 and performs the grilling effect, but may project forward through the opening part to cook food in a cook-top way when required.

The construction and operation of an electric oven according to the embodiments of the present invention will be described below with reference to FIGS. 1–4.

At first, to use an electric oven in an oven-way according to the present invention, food and/or a cooking container C may be placed in the cooking cavity 11 so the food and the cooking container C may be situated on the upper surface of the plate shaped heater 20 when the heater stays in the cooking cavity 11. Then the door 13 may be closed.

The connecting projections 16*a* of the connecting terminal 16 connect with the first connecting parts 22*a* when the electric power is on, and the electric power is transmitted to the electric heat coil 21 from the first connecting parts 22*a*, and the heat generated from the electric heat coil 21 heats the inner surface of the cooking cavity 11 so that food is cooked in a conventional oven way by its heat.

In addition, users may want to cook food in a cook-top way by using the electric oven according to the embodiments of the present invention by opening the door 13 so that the heater 20 moves forward along the guiding rails 15 and is projected through the opening part. Then the food and/or the cooking container C is placed on the upper surface of the heater 20 while it projects through the opening part.

The connecting projections 16*a* of the connecting terminal 16 connect with the second connecting parts 22*b* when the power is on, electric power transmits to the electric heat coil 21 through the second connecting parts 22*b*, and the heat generated from the electric heat coil 21 is transmitted to the food or cooking cavity 11 so as to cook the food in a cook-top way.

As described above, the present invention provides an electric oven with a heater 20 which is movably mounted in the cooking cavity 11 so as to heat the inner part of the cooking cavity 11 to cook food in a conventional oven manner, but the heater 20 also moves forward to project toward the front of the cabinet to heat the food or the food container C on top of it to cook the food in a cook-top way.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. An electric oven comprising:

a cabinet forming an appearance of a microwave oven;

a cooking cavity defined inside the cabinet and having an opening front part to contain food therein;

a heater movably mounted in the cooking cavity to heat an inner part of the cooking cavity in a conventional way when positioned inside the cooking cavity and movable forward from the cooking cavity through the opening part, receiving electric power to cook food in a cook-top way, wherein the heater has connecting parts at front and rear ends thereof to receive electric power; and a connecting terminal provided in the cooking cavity to supply electric power to the heater by connecting with the front connecting parts of the heater when the heater stays in the cooking cavity and by connecting with the rear connecting parts when the heater is projected through the opening of the cooking cavity, wherein the connecting terminal comprises guide protrusions to be connected to the connecting parts, the connecting parts are concave with respect to the heater and the connecting terminal, and the connecting parts are made of elastic material to allow vertical movement thereof.

* * * * *